US008083599B2

(12) United States Patent
Crawford et al.

(10) Patent No.: US 8,083,599 B2
(45) Date of Patent: Dec. 27, 2011

(54) ROTATING RIDES WITH INTERACTIVE WATER FEATURES

(75) Inventors: David W. Crawford, Long Beach, CA (US); Timothy J. Delaney, Calabasas, CA (US)

(73) Assignee: Disney Enterprises, Inc., Burbank, CA (US)

( * ) Notice: Subject to any disclaimer, the term of this patent is extended or adjusted under 35 U.S.C. 154(b) by 534 days.

(21) Appl. No.: 12/168,991

(22) Filed: Jul. 8, 2008

(65) Prior Publication Data

US 2010/0009767 A1 Jan. 14, 2010

(51) Int. Cl.
*A63G 1/08* (2006.01)

(52) U.S. Cl. ..... 472/13

(58) Field of Classification Search ..... 472/13
See application file for complete search history.

(56) References Cited

U.S. PATENT DOCUMENTS 4,960,275 A * 10/1990 Magon ..... 472/13
6,045,449 A 4/2000 Aragona et al.
6,561,914 B2 * 5/2003 Henry ..... 472/13
6,629,501 B2 10/2003 McKoy
2009/0118024 A1 * 5/2009 Yule ..... 472/128

OTHER PUBLICATIONS

Joel Rogers, Roller Soaker, 2003, www.CoasterGallery.com.*

* cited by examiner

*Primary Examiner* — Gene Kim
*Assistant Examiner* — Michael Dennis
(74) *Attorney, Agent, or Firm* — Marsh Fischmann & Breyfogle LLP; Kent A. Lembke

(57) ABSTRACT

A rotating ride for use in water parks and other settings to provide ride passengers or park guests with an interactive water experience. The ride includes a structural system with a drive that rotates a support structure such as a wheel frame about a central axis or hub. The ride includes a plurality of vehicles that each includes a body with seating for passengers and that is connected to the support structure and rotates with it. The vehicle assembly includes a water release mechanism that is passenger operable to release water from the vehicle as it is moved through the ride path. The vehicle body may include a water storage reservoir storing a volume of water that then can be selectively released by the passenger. The stored water may be caught as it pours over the vehicle or the vehicle may pass through a pool to scoop up the water.

19 Claims, 12 Drawing Sheets

ROTATING RIDES WITH INTERACTIVE WATER FEATURES

BACKGROUND OF THE INVENTION

1. Field of the Invention

The present invention relates, in general, to water attractions and rides such as may be provided at water parks and amusement/theme parks, and, more particularly, to a water-based ride in which passengers in ride vehicles or on the ride are able to interact or play with water in a rotating ride.

2. Relevant Background

Water parks or recreation areas have become increasingly popular. For example, water parks are typically destination facilities including many areas for guests or visitors to swim and play in water. These destination water parks typically have standard pools, wave pools, water slides, and other areas where kids and adults can simply play in and with water such as in lazy rivers where water sprays guests in inflated tubes or on rafts. Water recreation areas or facilities are often provided at resorts and hotels and are typically provided on a smaller scale such as with a pool with a fountain, a waterfall, and water slides. It is also common for amusement parks and theme parks to include a water-based ride where the vehicle floats in or moves through water, and thrill is added by the anticipation and expectation that at least some of the passengers will get splashed or even soaked with water such as when vehicles drop rapidly into a pool of water or travel near spraying water.

While exciting and largely popular, most existing water-based rides provide little opportunity for the passengers to control the experience. For example, most water rides in amusement or theme parks use chance and luck of positioning and/or timing to determine which passengers get wet or are placed near a spray of water. Other rides may move all the vehicles through water spray or even immersing passengers, but the passengers have no control or ability to adjust the experience as they know each time they take the ride it will be about the same as last time. Some of the more popular water slides are the ones in which the participants can change their speed, direction, and other aspects of the rides by adjusting their weight, holding their body or tube in a different position, and taking other actions. The interaction portion increases the enjoyment, and ride designers continue to look for ways to provide water-based attractions that provide more guest interaction.

Another challenge for water attraction and ride designers is size and cost associated with installation, operation, and maintenance. A typical water ride at an amusement park may have a large footprint similar to a typical roller coaster or dark ride and cost millions of dollars to design, fabricate, and install. These large water rides may also require multiple operators to load and unload passengers and otherwise operate the ride. Maintenance may be quite expensive as wheels, bogies, and other mechanical and rotating parts are exposed to water. Similarly, the most popular wave pools and water slides are quite large and may be expensive to build and often require close supervision by operators to operate the attraction and/or to provide proper levels of guest safety. It has proven difficult to design a safe and easy to maintain water feature with a relatively small space or footprint requirement, and many hotels and resorts have decided not to provide water attractions beyond a conventional pool.

Hence, there remains a need for water attractions and/or rides that address the demand for interactive and unique water experiences which in some cases can be provided with a small footprint and may be relatively inexpensive to install, operate, and maintain.

SUMMARY OF THE INVENTION

The present invention addresses the above problems by providing ride systems or rotating rides that include water features that provide passengers or riding guests with an interactive experience. The rotating ride may be provided on a variety of drive assemblies or platforms such as a rotating wheel (e.g., a Ferris wheel), a round iron ride, a carousel, a flying or rotating swing ride, and other rotating ride designs. Rotating ride embodiments may be thought of as including three subsystems or aspects. First, a storage aspect or subsystem may be provided with vehicle bodies or passenger compartments with water storage reservoirs or containers as an integral or add-on feature of the body (e.g., a hollow chamber or chambers under the seat or bench of the vehicle body). Second, a fill aspect or subsystem may be provided to provide water for release or discharge from the vehicle body. The fill subsystem may include providing a pressurized supply to direct water to the vehicle body such as to refill the storage reservoir while in other embodiments the fill subsystem is achieved by configuring the vehicle body for catching or collecting water poured into or over the vehicle body or for scooping water from a pool (e.g., the vehicle body or the collection portion is pulled or dragged through a body of water provided in or near the path of the rotating vehicles). Third, a release or discharge subsystem may be provided to allow the passenger to selectively trigger (and, in some cases, direct or aim the outlet direction) release of the water from the storage tank, and the release subsystem may include a trap door defining one wall of the storage reservoir and a lever to open this door whereas some embodiments may include a water cannon or super soaker device that can pressurize the stored water and can be operated to shoot the water out from the vehicle body.

More particularly, a rotating ride is provided for use in amusement parks, water parks, and other settings to provide ride passengers or park guests with an interactive water experience. The ride includes a structural system with a drive assembly that rotates a support structure (such as a wheel frame, vehicle support arms, a carousel or similar platform, chair connectors/supports, and the like) about a central axis or hub. The ride further includes a plurality of vehicles or vehicle assemblies that each includes a body with seating for one or more passengers. The body is connected to the support structure and rotates with it about the hub or central axis. The vehicle assembly also includes a water release mechanism that is operable by the passenger to release water from the vehicle while the vehicle is rotated through the ride path.

The vehicle body may include a water storage container or reservoir that stores a volume of water that then can be selectively released by the passenger. The stored water may be collected from a water supply that has an outlet that pours or sprays the water onto and/or into the body where it is captured via one or more openings in the water storage reservoir. The ride may also include a pool or body of water that is positioned relative to the structural assembly such that a collection inlet to the water storage reservoir is exposed to or passes through the body of water to scoop up or collect the volume of stored water. The body may include a release mechanism operable by the passenger to selectively create an outlet in the water storage reservoir to discharge all or a portion of the stored water volume. For example, the created outlet may include a trap door or the like that is operable by a release lever or latch accessible by the passenger in the body. The water release mechanism may also include a device (such as a pump-operated discharge device or water cannon) that is able to withdraw water from the reservoir, to pressurize the water, and trigger selective discharge of the pressurized water, and the outlet of this device may be positionable to allow the passenger to direct the discharged water toward a user-selected target.

DETAILED DESCRIPTION OF THE PREFERRED EMBODIMENTS

Briefly, embodiments of the present invention are directed to ride designs and systems for use in resort settings such as a small water park or add on feature to a pool area, in amusement and theme parks as a water ride attraction, and/or in water parks or water theme parks. The embodiments generally include a rotating ride (or ride system) that includes ride vehicles adapted for collecting and/or storing water as the vehicle is rotated (e.g., in a vertical or horizontal plane or the like) and also for allowing passengers to control the release or discharge of water from their vehicle. For example, the passengers may operate water discharge or release controls to open a panel or chute in the bottom of their vehicle's passenger compartment or body to dump collected water on vehicles below them or on spectators near the ride. In other cases, the passengers may be able to select a direction and/or trajectory for the water discharge or release and the water may be "fired" outward from the sides, bottom, or even top of the vehicle compartment/body such as at spectators about the periphery of the rotating ride. In some applications, passenger interaction is further enhanced as the passengers may be able to move a retractable or positionable shield or cover to try to avoid being hit by other vehicle's released water and/or the passengers may be able to take actions to increase their water collection or storage (e.g., operate a mechanical pump, move foot pedals, swing their vehicle body into a water storage pool or water supply spray or waterfall, or the like).

Figure 1:
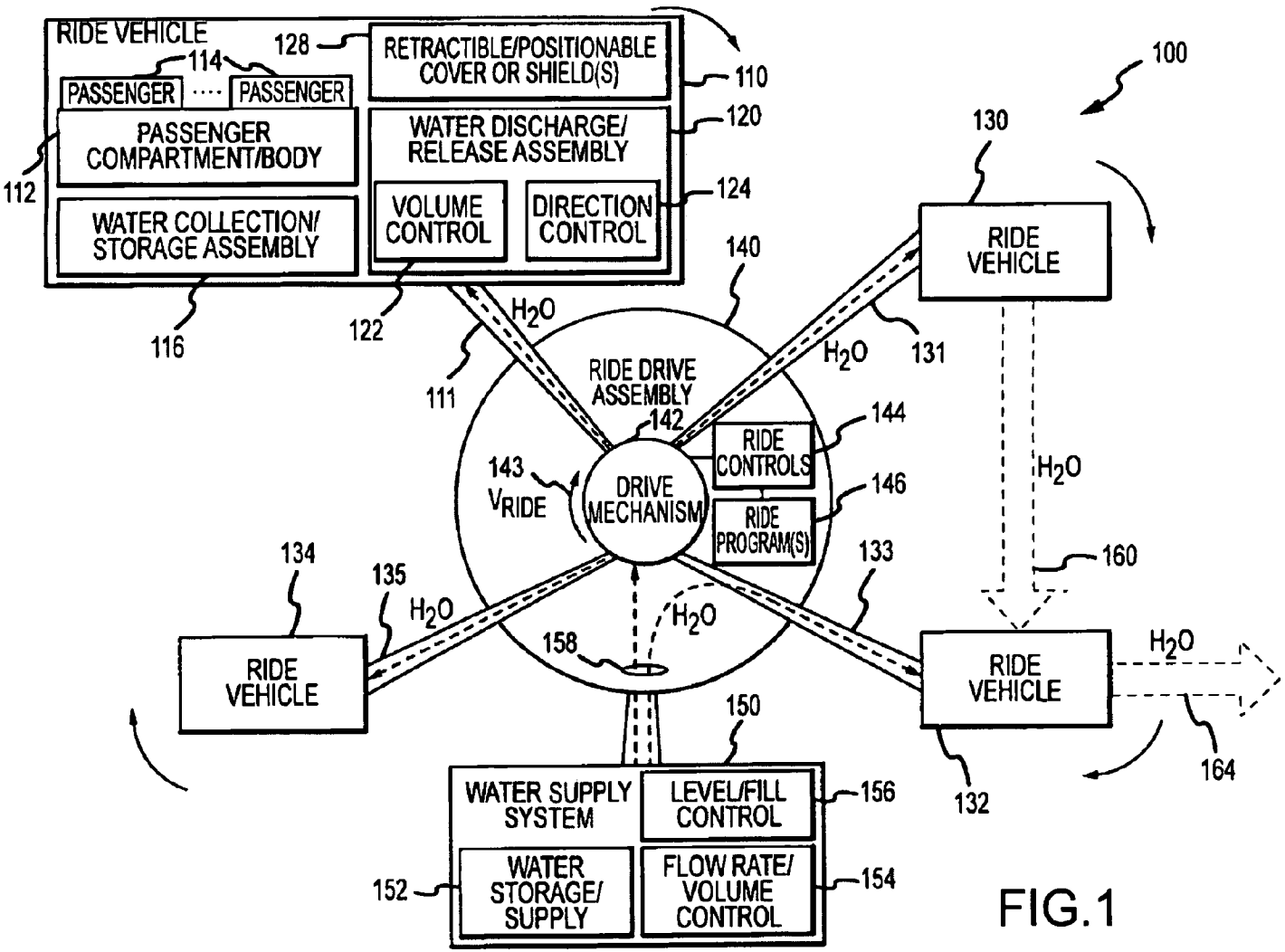
FIG. 1 is a functional block diagram of a rotating ride with interactive water features.

The following description begins with a general description of aspects of rotating rides configured according to aspects of the invention with reference to FIG. 1 and then proceeds with more specific descriptions with reference to additional figures of particular exemplary embodiments (e.g., an interactive water wheel, an interactive round iron ride, an interactive water carousel, and a water swing). These specific embodiments provide examples of how some of the features/aspects of the ride system of FIG. 1 may be implemented in practice in resort/hotel based water parks, in theme/amusement parks, in large water park settings, and in other applications. Prior to turning to the ride system of FIG. 1, though, it may be useful to provide further overview of interactive water rides and how the inventors' solution addresses some of the design challenges and demands.

The inventors were searching, in part, for a new and unique ride experience for a smaller water park environment. Hence, their initial design parameters included a small footprint, low investment or design and installation cost, user or guest interaction, a fun and memorable experience, and, in most cases, an opportunity to get very wet. To these ends, one embodiment or concept was to provide a relatively standard or convention Ferris wheel over a water element (e.g., a pool or other water storage).

Water storage was integrated into the individual chairs or vehicle bodies/passenger compartments, and release/discharge devices were provided for each chair such as a foot pedal to open a trap door, a lever to rotate the water storage to dump out water, and so on. In operation, the chairs are rotated by the drive mechanism of the ride (e.g., are pivotally attached to a rotating wheel or spoke-like frame as with other Ferris wheel-type rides) and at the bottom of their travel the chairs scoop up water from the water element, e.g., the water storage may be open toward its top or on a side and fill when the trap or release gate is closed (not activated by the passengers), as the vehicle travels in a partially submerged manner through the water. In other embodiments, water is provided to the vehicles or chairs with tubing/hoses and/or is provided from water falling or spraying from above or from the side of the vehicle or chair. For example, the wheel may travel through a waterfall, under or next to an outlet of a water chute/discharge pipe (e.g., one designed to appear to be a stream or the like), and/or under or near a spray of water. There are many other ways to fill the onboard water storage reservoir or tank with scooping and overhead filling only being two examples. In other cases, direct filling may be provided with feed lines/tubes provided from a water supply into the reservoir/tank of the vehicles. More indirect water capture may also fill a chair such as catching or capturing of water sprayed or dumped upon a vehicle from other vehicles or from outside sources (e.g., a water supply portion of the ride or from participants of the water park that spray riders in the vehicles and so on) to supplement the vehicles "standard" fill.

Once a chair has collected/received and stored a volume of water (or other liquid), on-board interactive devices such as buttons, pedals, levers, and so on may be operated by the guests or passengers to dump or release the water at any point in the ride cycle (e.g., circular path of the wheel ride). In other words, a passenger may pull a lever when their chair is positioned over another chair on the ride to soak its passengers or a spectator walkway or non-rider area (such as a pool or other water attraction) may be provided below the ride such that chairs at an outer edge or portion of the ride path may release water upon unexpecting (or expecting and even taunting who want to get wet) spectators or non-riders/passengers. Such water collection or capture and release may occur on every revolution continuously. The ride may rotate in either direction (clockwise/forward or counterclockwise/backward) or both such as to alternate the ride experience and allow "payback" or "revenge" splashing by placing differing chairs/passengers over and under each other during a ride cycle/program.

Guests or passengers may load into the chairs or vehicle passenger compartments in a variety of ways such as stepping into and wading through the water in the water element that acts as a water supply or from a load platform that may be actuated to extend over the water element or elsewhere to the vehicles or individual chairs. The interactive rotating water ride differs from other water rides that use water as a motive force or that dunk passengers as it provides onboard water storage in a rotating ride setting and also provides user-selected release or discharge of the collected water. Rotating rides of the invention may also provide a number of useful advantages such as being useful in smaller parks since their footprint can be quite small. The initial cost may be low as existing rotating ride technology (such as the drive and vehicle support portions) may be utilized and added features are relatively easy to add to a rotating ride configuration. Attraction size and capacity are scalable and directly relate to the quantity of seats installed and size/diameter of the ride or its "wheel," which allows the ride to be used in a variety of applications ranging from smaller hotel/resort settings near their pool or water park area and niche parks to major theme and water parks and urban entertainment centers. The ride may be configured and operated (e.g., run according to one or more ride programs/control modules) to provide a unique and variable ride experience, to encourage passenger interactivity in game play, use of strategy in capturing and releasing water, and technique development (e.g., how best to capture water, aim/release water, and, if desired, avoid others' showers).

Referring now to FIG. 1, rotating ride 100 is shown in functional block form and may generally be based upon a round iron ride (e.g., vehicles attached to hub generally are rotated in horizontal planes about the spinning hub) or a Ferris wheel type ride (e.g., chairs or vehicles are pivotally attached to a wheel to rotate in the vertical plane of the wheel). The rotating ride 100 is adapted to provide the aspects of water collection/capture and onboard water storage and also to provide passenger interactivity by providing user-selected discharge or release of the stored water ("water" in this description is meant in include any liquid that may be used in a water park setting).

The ride 100 includes a plurality of ride vehicles 110, 130, 132, 134 with vehicle 110 shown in more detail with the understanding that in most embodiments the vehicles 130, 132, 134 would take a similar form and/or have similar components/features. The ride vehicle 110 includes a passenger compartment or body 112 upon which or in which one or more passenger 114 may ride or be carried. The term vehicle body 112 is intended to cover anything that a passenger may sit within such as Ferris wheel type chair or an enclosed vehicle with seats to swing-type chairs to objects that passengers ride upon such as inflated tubes and carousel-type animals/characters/benches. Each vehicle 110, 130, 132, 134 is supported or attached to a drive mechanism 142 of a ride drive assembly 140 such as via support members 111, 131, 133, 135, which may be a wheel with its mechanical connections to chair, mounting components to attach the body 112 to a carousel, and/or arms or cable/chains connecting a swing chair or round iron ride passenger compartment to the central hub or drive mechanism 142.

During operation of the ride 100, ride controls 144 that may operate based on operator input and/or ride programs 146 (e.g., stored software routines dictating speed and direction of drive 142 over the ride cycle) act to operate the drive mechanism 142 to cause it and attached vehicles 110, 130, 132, 134 to rotate 143 at a desired velocity, $V_{ride}$, and in a desired direction (which may be either clockwise or counterclockwise and be varied within a single ride cycle for some ride programs 146 or based on operator manipulation of controls 144). The particular drive mechanism 142 used in the ride 100 is not limiting of the invention and may be the same or similar to those presently used for rotating rides (e.g., drive mechanisms for Ferris wheels and the like, for round iron rides, for swinging chair rides, and for other conventional rotating rides), with, in some cases, modifications being made to protect portions of the drive 142 from water and/or corrosive environments.

Significantly, the ride vehicles 110, 130, 132, 134 further include interactive water features. As shown with vehicle 110, each vehicle may include a water collection and storage assembly 116 that is onboard the vehicle 110. The assembly 116 may include a reservoir or tank for storing a particular volume of water, e.g., a small amount such as a quart up to a large amount such as several gallons or more, with the amount of storage varying depending upon the body 112 design and the configuration of the ride 100 (e.g., store more for slower moving rides with larger bodies 112 such as a Ferris wheel-type ride and store less in fast moving rides with small chairs/bodies 112 such as a rotating swing ride). Water collection or receipt components may also be included in assembly 116 such as tubing, piping, and valves to allow water to be pumped onto the vehicle body 112 from a water supply (e.g., supply 152) or openings with diverters/guides/channels and so on to scoop water from a pool or to catch and retain water entering or striking the body 112 from above or the sides. The location of the storage assembly 116 may vary also to practice the invention and may typically be at a lower portion of the vehicle (e.g., as part of or below a seat/bench) to allow release/discharge onto vehicles below but other embodiments may provide the tank/reservoir on a side of the vehicle or even at a high point (e.g., where it may be caught from above and/or to provide added head for discharge from the vehicle 110).

In addition to catching/receiving and storing water onboard, the ride vehicle includes a water discharge or release assembly 120. Preferably, the vehicle 110 is configured such that a passenger 114 can operate one or more portions of the assembly 120 to interactively or selectively choose when to release the stored water in assembly 116 and, in some cases, even to select the amount and/or direction of such release (e.g., selective passenger or guest release of stored/captured water). For example, a lever, button, or knob may be provided to activate a mechanical release assembly such as a trap door in the bottom or side of the reservoir/tank or the assembly 120 may include a water "cannon" or similar device with a trigger or other mechanism allowing the passenger 114 to select when to release water from assembly 116 (which may be under pressure in some embodiments). The release assembly 120 may include a volume control 122 such that the water may be released in a preset or selectable amount or at least to govern or throttle the water output, e.g., a foot pedal may be used to fully open a trap door in a reservoir or the opening may be proportional to the movement of the pedal with less water released if the pedal is only partially activated or moved by the passenger 114. Direction control 124 may also be provided on the vehicle 110 such as with a pivotal vane (e.g., right/left, up/down, etc), with a discharge head/outlet that is movable or pivotal by the passengers 114, and the like. Such directional control 124 may be adapted to allow the passengers 114 to select their target and may add to a learned/ practiced aspect of the ride 100. This may be used to direct the water downward as shown at 160 toward another vehicle or to the side as shown at 164 to target outside targets and spectators, and in some cases, the direction may be angled or sent at a trajectory from the vehicles (e.g., rather than always straight down or straight out a side of the vehicle body).

The vehicle body 112 may be open or unprotected from water targeted at the passengers 114. As shown, the vehicle 110 may optionally include one or more retractable or positionable covers or shields to allow the passengers 114 to try to block some or all of water that is directed toward them by other passengers in other ride vehicles 130, 132, 134 or from a water supply (e.g., supply 150) that may include a waterfall or similar large volume flow of water that passengers 114 may want to capture with assembly 116 but at least partially block to control the water flow. For example, the cover or shield 128 may include a plastic partial cover for the compartment 112 that can be pivoted on side mounts to allow passenger loading, be rotated over their heads to block water from above (and possibly from the sides), and to the front to block water from striking the front of the passengers 114.

As the vehicle 110 rotates 143, it is able to fill its water reservoir or tank of the assembly 116 with more water. To this end, the ride 100 includes a water supply system 150 that provides water from a water storage or supply 152 (e.g., storage tank, a collection tank from the ride and its water elements, and/or fresh/make up water supply) as shown at 158. The supply system 150 may be configured such that the water storage 152 is at least partially exposed to the vehicles 110, 130, 132, 134 such as in the water wheel embodiments such that these vehicles may scoop water with collector portions of the assembly 116. In some embodiments, the supplied water 158 is provided to the vehicles from overhead (or side sprays) and the water collection assembly 116 is adapted to catch water as it falls into or strikes the passenger compartment 112, e.g., the vehicle 110 may pass through a waterfall like feature or the outlet of a large water pipe and so on and a collector may simply be open portions and the upper portions of the water storage tank/reservoir. In other embodiments, the supply water 158 may be pumped via piping/tubing directly into the storage tank of assembly 116 in each vehicle, e.g., by automated control of the ride controls 144 and/or ride program 146. In such cases (as well as the overhead and/or side-spray cases), the water supply system 150 may include a level or fill control 156 to maintain a water element at a desired level and may include a flow rate/volume discharge control 154 to provide desired (and sometimes varying) volumes of water 158 to each vehicle. The water supply 158 may be relatively steady, may be varied such that differing vehicles may receive more water (e.g., based on chance or based on interaction of the passengers 114 such as by hitting a target with their water discharge), and/or may be based on amount of use (e.g., automatically refill a reservoir in storage assembly 116 as a passenger 114 uses the water).

As can be seen, rotating rides can be made into unique, interactive experiences. This may be achieved by designing a new ride based on prior rotating ride technology to include three major subsystems/features or by retrofitting/modifying an existing ride infrastructure to integrate such subsystems/features. These subsystems (as shown in FIG. 1) include a water fill system, a water storage system, and a water release system (with the latter two systems being located wholly or mostly on or in the vehicle body or passenger compartment/chair). Each of these major subsystems/features may be realized in multiple ways and configurations depending on the particular application.

For example, the water storage may be a reservoir or container that is onboard or on the vehicle body or it may be a more off board source (e.g., providing water on a more continuing basis as used/needed by the water release device). The water fill for the onboard container may be a scoop-type device when the water supply/source is a pool of water or the like, may be a catch-type device when the water is poured down upon or sprayed at the vehicle body, and/or be an autofill-type device that may include a water fill line linking a water supply to the onboard container or reservoir. The water fill for an off board source may be a reservoir/container or may be a pressurized water supply.

The water release or discharge methods may also be varied to implement a rotating ride of the invention. For example, the release or discharge may be a mechanical assembly or mechanism such as one that does not require power (beyond that provided by passenger). Such a release may include a trap door on the container/reservoir that can be opened by the passenger(s) such as with a handle, lever, knob, foot pedal, or the like. The mechanical release may be a lever or a latch connected to a door or other device opening the container and releasing the water. Either of these may have a spring or resilient member that returns the trap door or other release element to a closed position in which water is retained in the container. The mechanical release may also be a pump or similar device such as a pump up/mechanical pressurization squirt gun or similar device to allow the passengers to spray or shoot the water more laterally and even upward from their vehicle. The water release method may in some cases be a powered release device such as a solenoid/latch, a pump, or other powered mechanism each of which may be selectively activated by the passengers (such as by them using a triggering mechanism, pushing a button, moving a lever, and the like). Note, any of these subsystems may be combined together in any arrangement/order on any of the attraction/ride examples described herein, with the following examples showing a single configuration of the storage, fill, and release subsystems for each of explanation and illustration but not as a limitation to the invention and its description.

Figure 2:
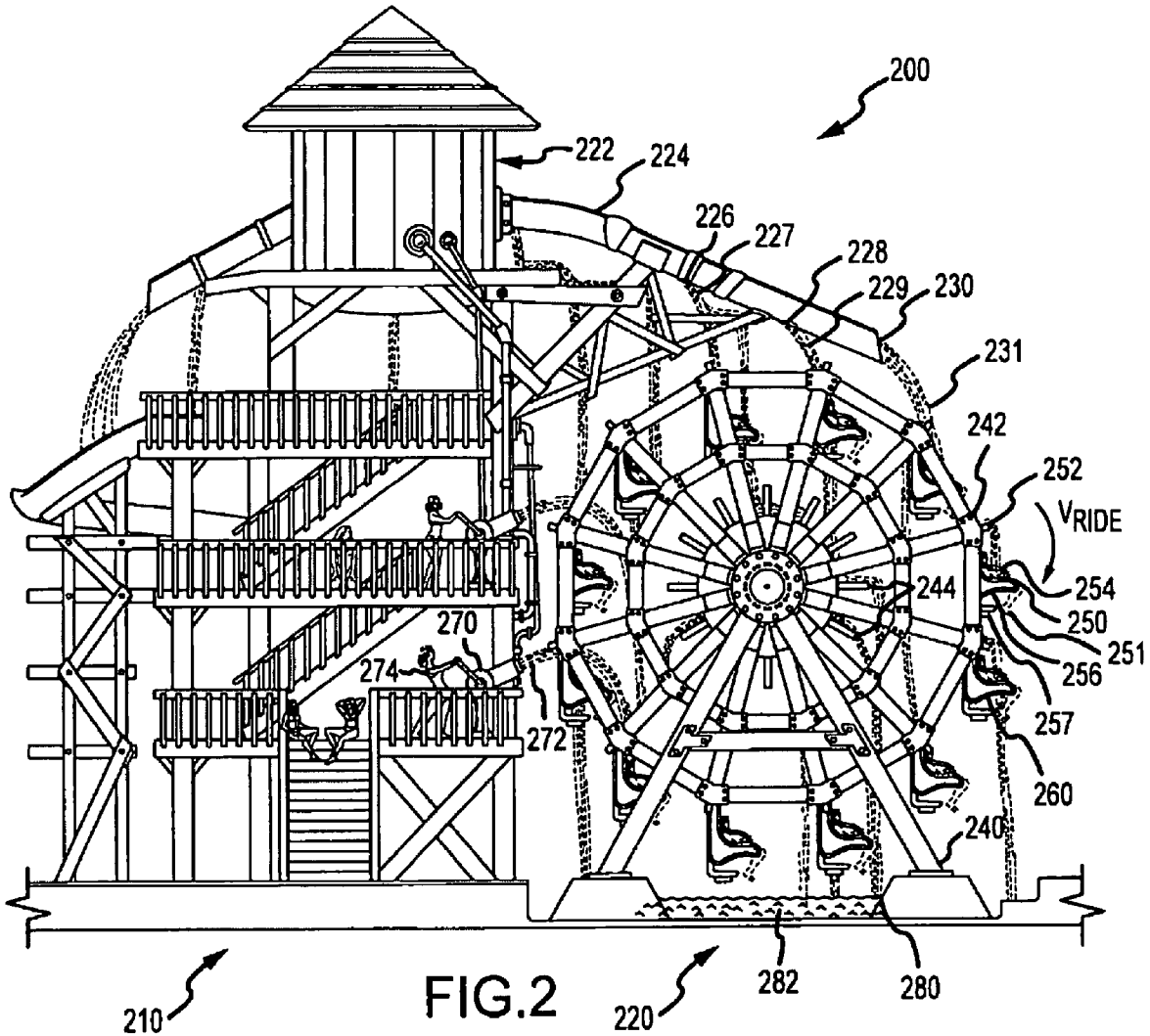
FIGS. 2 and 3 are side and end views of an embodiment of a rotating ride with interactive water features illustrating use of a rotating water wheel configuration with overhead and side filling of water into onboard vehicle collection/storage assemblies.
Figure 3:
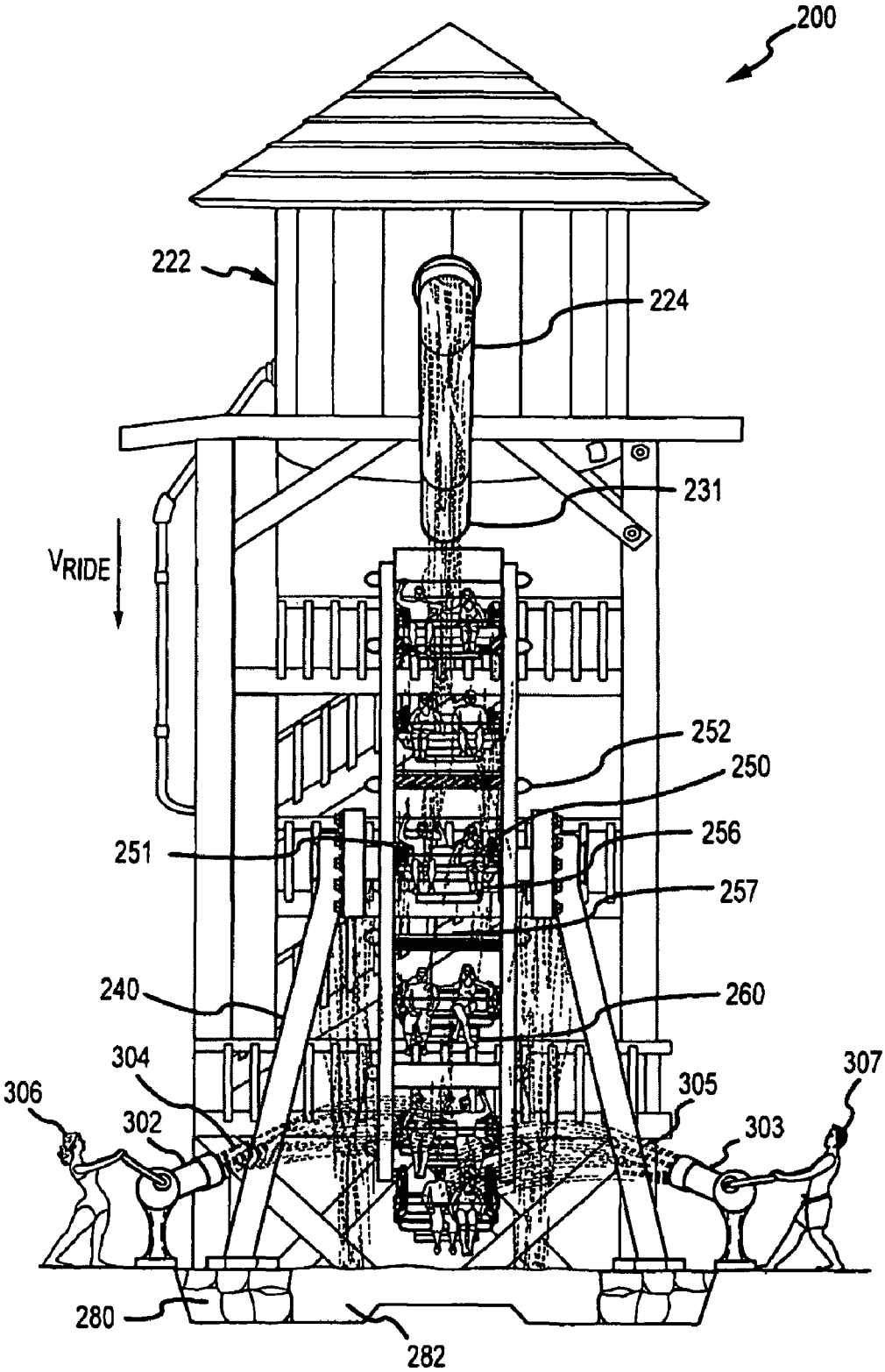

FIGS. 2 and 3 illustrate in more detail an embodiment of a rotating ride 200 that implements the features/subsystems of fill/collection, storage, and release as discussed above within an attraction well-suited for use in water park (small and large) settings and other environments. As shown, the ride 200 is themed as a lumber mill with a rotating wheel assembly 220 supported by structural elements 240. The wheel assembly 220, although electrically or otherwise driven about its hub or center 242, is designed to appear to be operating as a more conventional water wheel driven by falling, e.g., to strike paddles 244 on the hub 242 or buckets/vehicles 250, 260 carrying the passengers/guests. A water supply 222 that may include a tank or simply pump return or fresh water is located at a high point of the ride 200 in this embodiment such that water may flow down over the wheel assembly 220. Optionally, a water slide tower (or non-riding participant structure) 210 may be positioned adjacent the wheel assembly 220 and allow one or more of the non-riding participants 274 to interact with riding participants or passengers in the wheel assembly 220 such as by spraying them with water 272 from a discharge device 270 (e.g., a fire hose, a water cannon, or the like) that can target select vehicles in the assembly 220, which may provide a portion of the collected or fill water provided to the vehicles 250, 260. In some embodiments, the vehicles 250, 260 may also release water onto the non-riding participants 274 such as with manually pressurized squirt guns, with powered devices that use water in the vehicle storage reservoir, by dropping water that can fall directly upon non-riding participants or be directed toward their location, and via other techniques.

In this embodiment 200, the fill/collection subsystem or aspect is provided by capturing or catching water as it falls into the vehicles 250, 260 or is sprayed on them by other vehicles or by non-riding participants 274 via cannons or the like 270. To this end, the water supply 222 includes a vehicle-filling discharge pipe 224 that may have a main/end outlet 230 that dumps a majority of the water 231 flowing from the supply 222 that pours down over the top of vehicles 250, 260 as they rotate on the ride path about the hub 242 at a particular ride velocity, $V_{ride}$ (e.g., a relatively slow rotation rate that may be steady or be varied during operation of the ride 200 and direction may be changed in some embodiments). The discharge pipe 224 may also have secondary outlets 226, 228 that also discharge water 227, 229 onto guests/passengers (e.g., more as spray than as fill water for their vehicles in this embodiment but the flow could be increased to provide fill at multiple points) and/or onto the paddles 244 to add to the appearance that water is driving the wheel assembly 220 about the hub 242 (and, note, in some embodiments, the paddles 244 are struck so as to travel in the opposite direction as wheel/vehicles 250, 260 so as to provide a unique visual effect).

Vehicles 250 (and 260 and the others) are pivotally mounted to the wheel assembly 220 as shown at 252 with pin or similar structural members. One or more passengers 251 ride in the body or chair of the vehicle 250 and, typically, are soaked or sprayed with water 227, 229, 231 as their vehicle catches/collects water to fill a container or reservoir provided in the vehicle 250, such as within a seat area or below the seat/bench with collection areas that are open (or have a mesh/grate cover or otherwise configured to allow water passage/flow) to a top or feed lines/chutes to the container or reservoir. As a result, the vehicle 250 is adapted to provide onboard water storage (e.g., the storage subsystem/feature of ride assemblies described herein). For example, the floor of the chair/body may be a mesh/grate structure that allows water to flow into the container/reservoir and/or a water fill/feed may be provided behind or in front of the bench/chair to catch water and direct it into an onboard reservoir. The third subsystem or water release/discharge is provided on the vehicle 250 with a handle/lever 254 that the passenger 251 can use to manually actuate a mechanical release such as a trap door or the like 256 at the bottom of the vehicle 250. This causes water 257 to fall upon a vehicle 260 below the vehicle 250 soaking its passengers. Again, in some embodiments, positionable shields/covers may be provided on the vehicles 250, 260 to allow some passengers/riding participants to try to avoid getting quite as wet. In some cases, only one release 254 is provided as well as one reservoir. In other embodiments, more than one of each the release 254 and reservoir are provided (e.g., one of each of these subsystems for each passenger/guest to allow each rider of a vehicle 250, 260 to interact or play during operation of the ride 200).

Additional features for ride assembly 200 may include a water element at the bottom of the wheel 220 such as a pool/basin 280 filled with water 282. The basin 280 and wheel structure 240 may be configured such that the passengers/vehicles do not contact the water 282, such that the passengers can reach the top of the water to drag their feet or the like, or such that some amount of filling of the water storage reservoir/container is done at the bottom of the rotation cycle (e.g., combine overhead filling or catching water with scooping). As shown in FIG. 3, additional non-rider stations (e.g., pressurized hoses, water cannons, and the like) 302, 303 may be provided to allow one or more non-riding participants 306, 307 to interact with the water aspects of the ride 200 such as by spraying riders/passengers 251 in the vehicles 250, 260 with water 304, 305 (or the water 304, 305 may be more carefully aimed to fill the vehicles 250, 260 with more water for the riders 251 to discharge such as in a more team-based game/atmosphere).

Figure 4:
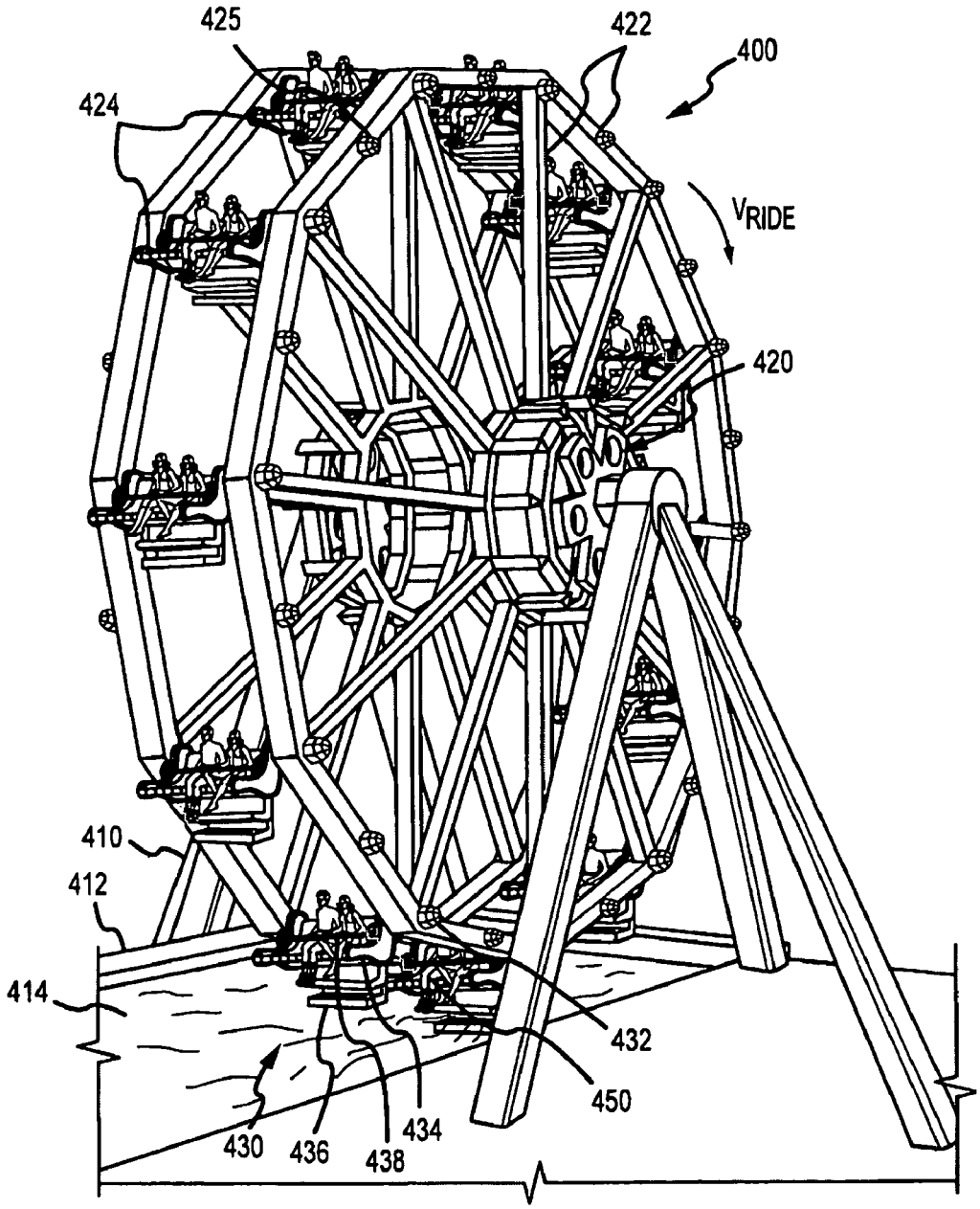
FIGS. 4-7 illustrate in perspective view and detailed perspective views another water wheel embodiment of the invention showing use of scoop or bottom filling or collection of water from a water element (e.g., a pool or basin) at the bottom of the wheel structure.

In other water wheel (or Ferris wheel type) rotating rides, the fill subsystem or feature may be a bottom fill from a pool, basin, or other water element that allows each passing vehicle to scoop or fill their tanks/reservoirs as they pass through or near the water element. FIGS. 4-7 illustrate an interactive water wheel ride 400 with a bottom fill or scooping action to catch or collect water. As shown in FIG. 4, the ride 400 includes a support structure 410 with beams or legs that support a drive assembly 420 over a water element 412 filled with water 414. The water element 412 typically is a shallow basin or pool that is several inches to several feet deep that functions to provide a source of fill or supply water 414 for the ride vehicles, e.g., the pool basin 412 and its contained water 414 may be thought of as part of the fill or collection subsystem/aspect of the ride 400.

The drive assembly 420 may include fairly conventional drive devices such as motors and such to rotate a hub about a central axis and cause the spoke-type frame 422 defining the wheel of the ride 400 to rotate at a ride velocity, $V_{ride}$ (e.g., clockwise as shown, counterclockwise, or both in a particular ride cycle). On the wheel frame/structure 422, a plurality of vehicle bodies or chairs 424 are attached with supports 425 that allow the chairs 424 to pivot and, in some cases, swing or rock through a fixed range of motion about the mounting supports 425.

Vehicle 430 is shown in a fill position of the ride cycle for ride 400 and is shown in more detail to illustrate the 3 subsystems of storage, fill, and release. The vehicle 430 is pivotally mounted at 432 to the wheel frame 422 and includes a body or chair 434 with a bench or seat for receiving/supporting one or more passengers 450. The chair or body 434 differs from typical Ferris wheel chairs as it is adapted to provide the storage, fill, and release subsystems that make the ride 400 an interactive water attraction. In this embodiment 400, the water storage subsystem is provided in an onboard container (s), the fill subsystem is provided with a scoop or pass-through collection mechanism/assembly, an the water release/discharge subsystem is provided with a mechanical released/actuated device (e.g., a trap door or the like with an interconnected lever release or the like). In FIG. 4, the vehicle 430 is shown with a water capture and/or storage assembly 436 extending from the bottom portion of the vehicle body 434. Storage may be provided just in this extension or, in part, in one or more containers within the body 434 (e.g., storage volume may be provided above or in connection with one or more trap doors or other water release devices). FIG. 4 also shows a release lever 438 provided adjacent or proximate to the seat to allow ready operation by the passenger 450 to actuate or initiate the release of water collected and stored within the vehicle body 434 (e.g., pull or push on lever arm 438 to open a door(s) in the bottom of the collection/storage extension 436).

Figure 5:
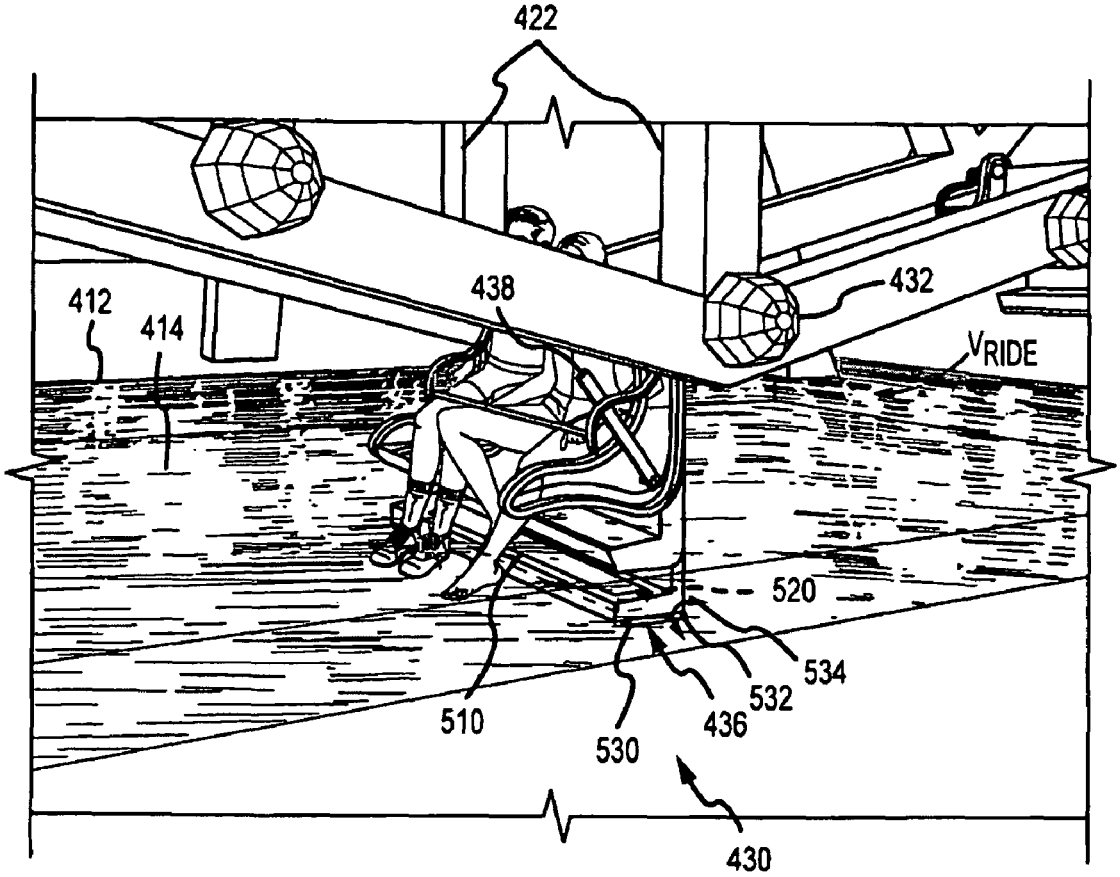

FIG. 5 illustrates with more detail the water collection feature of the ride 400. As shown, the wheel structure 422 rotates the vehicle 430 down toward and through the water basin or element 412. The water collection and storage assembly 436 is shown to include an inlet or opening 510 (e.g., a fully open or an opening with grating/slits/mesh holes to allow water but block larger objects) through which water 414 flows or is scooped as the assembly/extension 436 swings or drags through the basin 412. Typically, the ride 400 is configured such that the opening 510 will be a distance below the surface of the water 414 in basin 412 and the distance may be an inch or more and typically is chosen to account for varying water levels 414 in the basin 412 throughout operation (e.g., the opening may be several inches below the surface when the basin is completely full and only an inch or less at expected low points).

The opening 510 may be at an upper portion of a front or rear/side wall or may be provided on an upper surface of the extension 436 (e.g., the collection and storage assembly 436 may have an L-shaped cross section as shown or be more rectangular or the like in cross to practice the invention with the significant feature being that the extension 436 extends into the basin at some point in the ride cycle and has one or more openings to scoop or receive water 414). Such collection may be relatively passive, but in some embodiments, the passengers 450 may have to take an action to capture water such as swing their chair to better position the opening or scoop water or operate a lever or other actuator to time the opening of inlet 510 (e.g., a retractable lid or shutter may be provided over the opening 510).

The assembly 436 further includes onboard water storage that is provided with a water container or reservoir 520. The reservoir 520 may be positioned in a variety of location, take a number of shapes and sizes, and be provided as a single chamber/container or as a number of vessels that can be concurrently or selectively discharged (e.g., a trap door or other release for each portion of the reservoir 520). As shown, the reservoir 520 is a single chamber that extends along a majority of the width of the assembly 436 (e.g., has a width of about the body 434 but may be wider or narrower than the body to suit an application). In this manner, the reservoir 520 may readily provide storage for a volume of scooped water 414 up to several gallons or more. The release of the collected water stored onboard in the reservoir 520 is mechanical in this embodiment 400 with a lever release 438 being operable by a passenger 450 to manually or mechanically force a trap door 530 provided at the bottom of the assembly 436 that is pivotally at pin/shaft 532 to rotate 534 from a closed position in which water is contained (but some leakage may be permissible in many settings as a tight seal is not typically required) in the reservoir 520 to a fully open position. The lever 438 may cause full release in some embodiments (e.g., the door 530 may fully open after a certain amount of travel of lever 438) while graduated/controllable release may be provided with a mechanical release as the lever 438 may be slowly or partially moved to release some water and then quickly and/or fully moved to release the rest of the stored water or to quickly release all of the water on a target. While not shown, some embodiments may also include targeting mechanisms in the release subsystem in addition to a mechanical release as shown. For example, manually operated or powered devices may be provided to swing guides or vanes in the outlet created by opening the door 530 or other devices may be used to cause water to flow laterally or at a particular trajectory/angle rather than mainly straight down (e.g., pivotal guide walls may be provided on the upper or interior surface of the trap door to provide some directionality to the water release or discharge).

Figure 6:
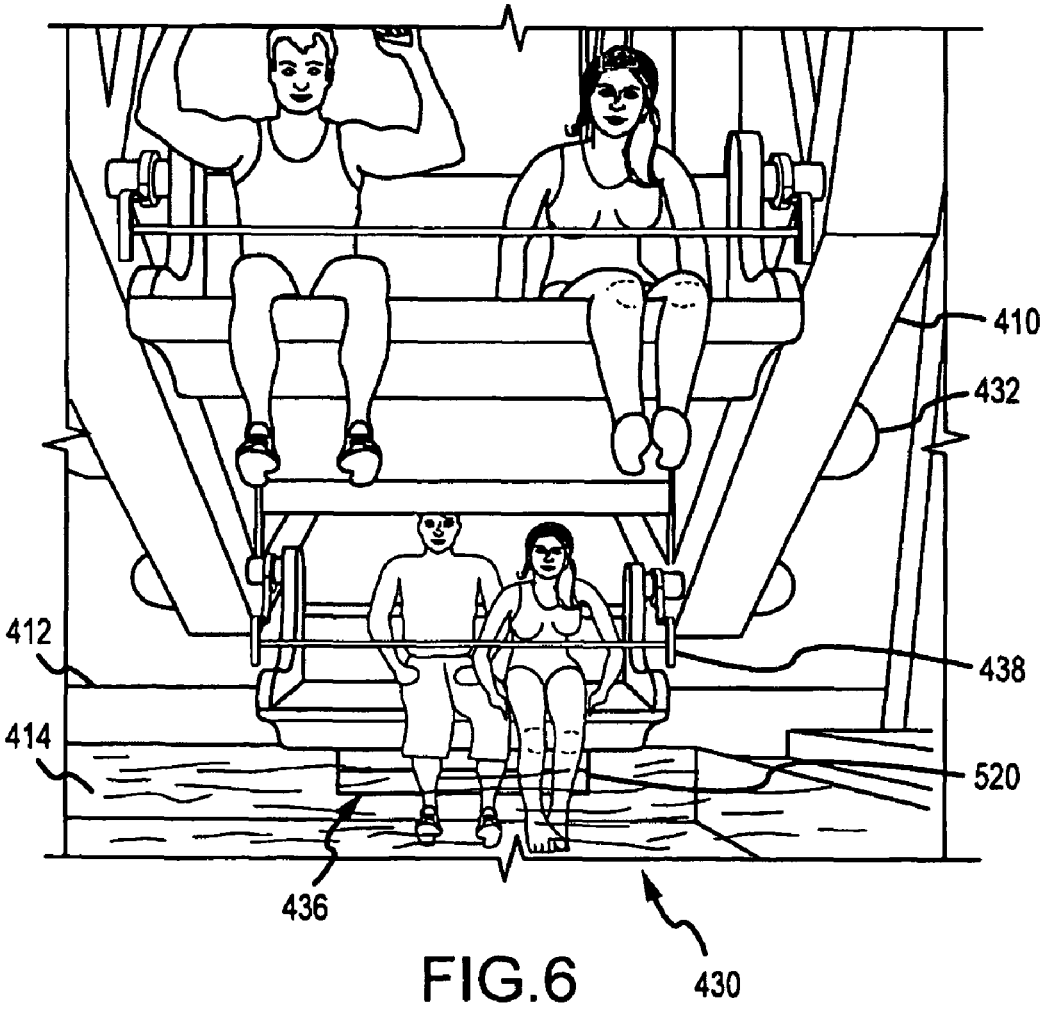
Figure 7:
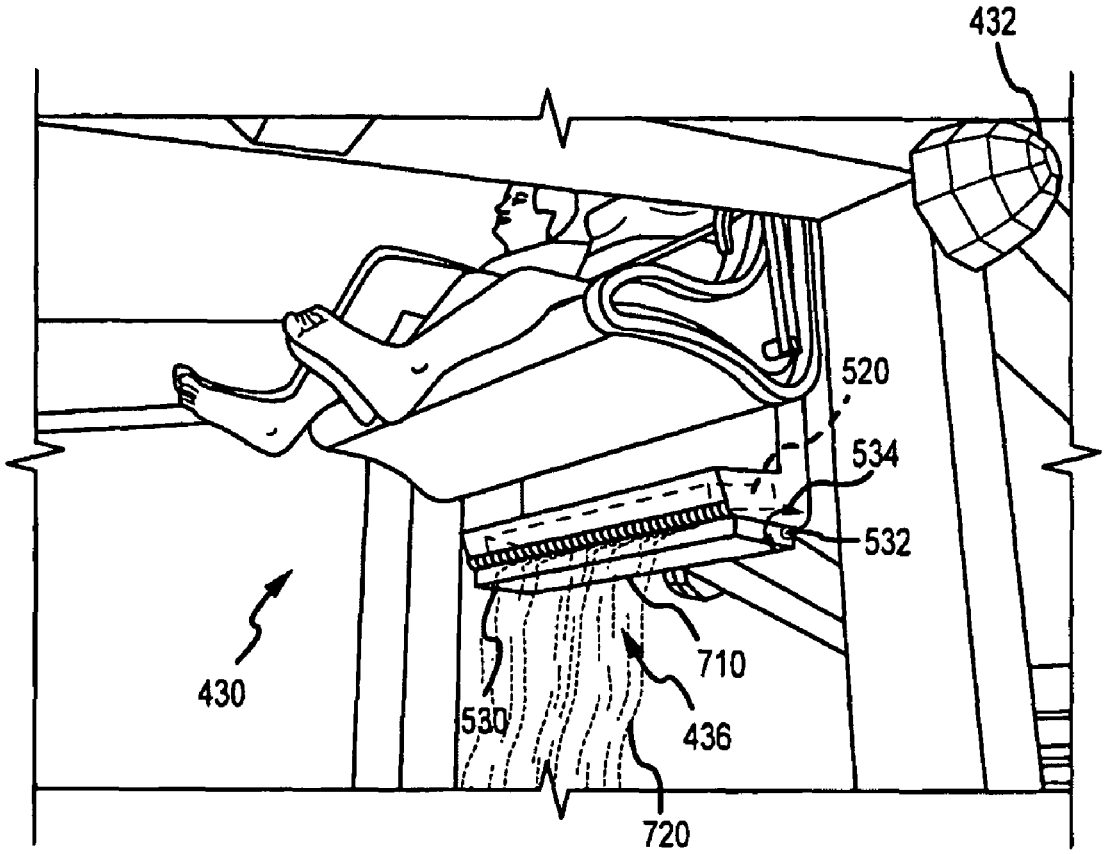

FIG. 6 illustrates the water collection or fill function of the ride 400 in more detail with a vehicle 430 being swung through the basin 412 to scoop or gather water 414 through the opening 510 into the water storage reservoir 520. FIG. 7 illustrates the water collection, storage, and release assembly 436 in more detail. As shown, the trap door 530 has been rotated 534 into an open position as shown with arrow 710. In this position, water 720 is discharged or released via the force of gravity from the storage reservoir 520. Again, the amount/rate of flow may be controlled in some cases by the amount of rotation 534 of the trap door 530, which is caused or forced by a passenger 450 moving the release lever 438. During typical operation, loading/unloading of passenger 450 may be achieved by stopping the ride 400 with a vehicle 430 at the bottom of the wheel structure 422, and passengers 450 may wade through the water 414 in water basin/pool 412. In other embodiments not shown, an actuated or retractable platform may be used to allow passengers 450 to walk over to the vehicles 430 in the bottom-most or another position in the ride cycle.

Figure 8:
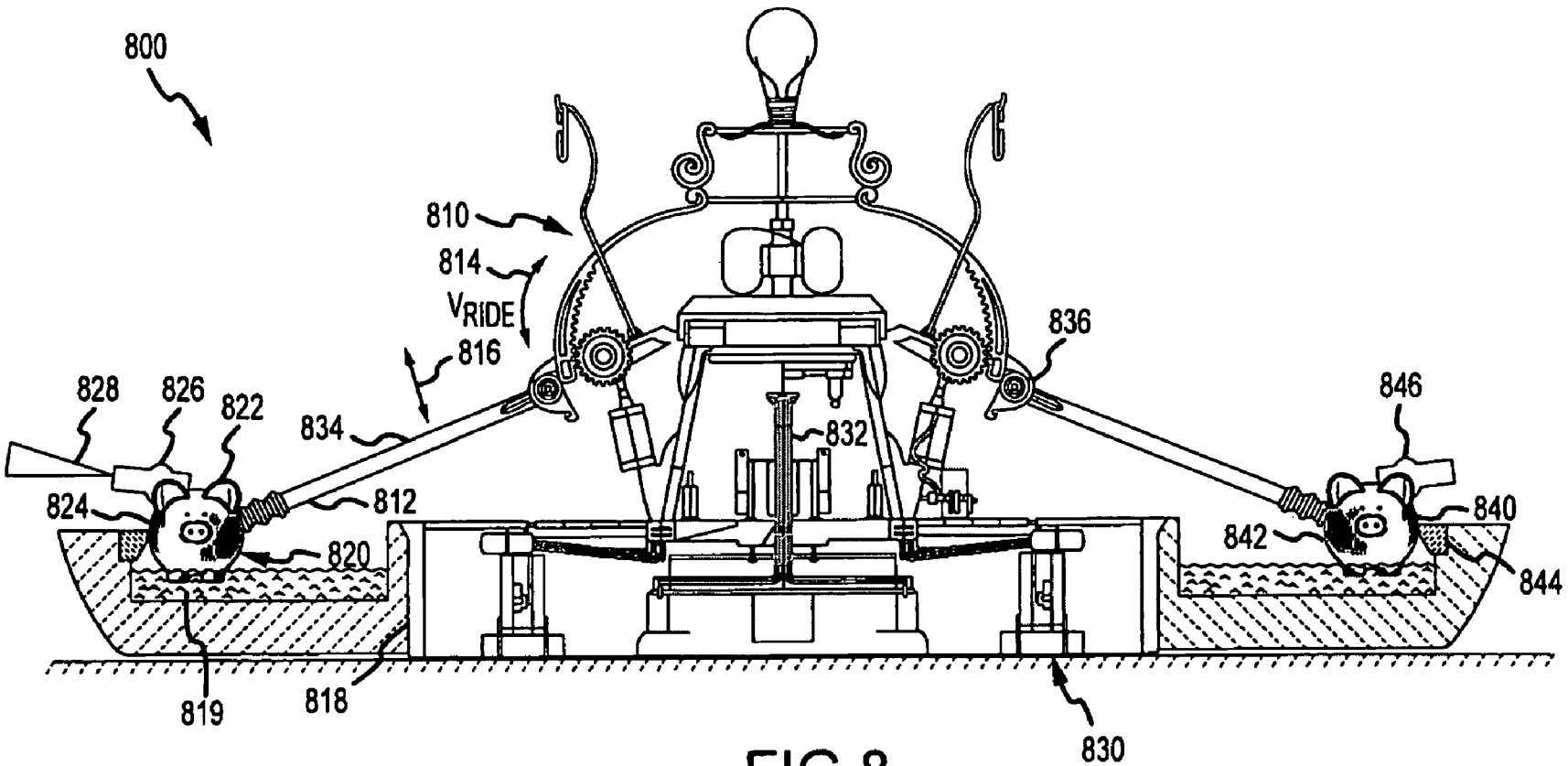
FIG. 8 illustrates another embodiment of a rotating ride with interactive water features of the invention in this case based on an round iron ride configuration with fill of water storage provide via support arms for the vehicles.

FIG. 8 illustrates another rotating ride 800 providing interactive water features. As discussed above, the particular type of rotating ride configuration may be varied to practice the invention with the Ferris wheel-type ride (or vertical rotation plane ride) being just one useful example. The ride 800 is built upon a round iron ride format that is used throughout the theme and amusement park industry (but, of course, without the water features described herein). As shown, a central drive assembly 810 is provided that is adapted to rotate about a central axis or hub at a range of velocities, $V_{ride}$, as shown with arrow 814 (in one or other the clockwise and counter-clockwise directions). A plurality of arms or lateral supports 812 extends out from the hub similar to spokes of a wheel. The drive assembly 810 is also operable to raise and lower as the arms 812 as shown with arrow 816. A like number of vehicles 820, 840 are mounted at the end of each of these arms 812 and are configured with bodies/passenger compartments 822, 842 for receiving one or more passengers. The ride 800 may optionally include decorative water features such as a pool or basin 818 containing water 819 under all or portions of the path of the vehicles 820, 840 about the hub of drive assembly 810, and these are optional in this case as fill does not involve scooping fill/supply water (but, it may be combined with the fill of ride 800 in some cases).

In the ride, water storage is provided with an onboard container 824, 844 in the bodies 822, 842. Water fill is provided in the embodiment 800 in a more automated manner or with autofill rather than requiring capture (e.g., collection, scooping, or the like) within the vehicle 820, 840. As shown, a water supply or fill system 830 is provided with a fill or inlet line 832 that is attached to a pressurized water source or to a water supply via a pump or the like. To provide the fill water to each vehicle 820, 840, a plurality of branch supply lines 834, 836 are provided in or attached to each support arm 812 with a first end connected to the inlet line 832 (or to a header filled by the line 832) and a second end connected to the onboard water reservoirs 824, 844. The system 830 may be thought of as a pressurized water hose/pipe/tube delivery system with auto fill. The filling may be controlled simply with a fill level detection device provided in the tanks 824, 844 such as to maintain the volume of water at desired levels (e.g., perform refill whenever a particular preset level is reached such as refill when emptied to one third or one quarter or some other level so passengers always or nearly always have water to release). In other embodiments, a Tide program may be used to provide fill control such as to fill only periodically (e.g., fill prior to the ride beginning and then again after a number of rotations or amount of time has passed), to fill certain amounts when the passengers perform some action (s) (e.g., successfully move their vehicle 820, 840 in a particular pattern, release water to strike a particular target, and so on), and/or according to other fill patterns/regimes.

The water release or discharge subsystem or feature may be provided in a number of ways in the ride 800. In the illustrated example 800, though, the water release is achieved via mechanical or manual methods. Specifically, a manual pump-based water cannon 826, 846 is mounted on or provided with each vehicle body 822, 842 and a passenger may hand (or foot) operate the pump to draw water into the cannon 826, 846 and to pressurize the water prior to ejecting it as a projectile or discharge spray 828. For example, the cannon 826, 846 may operate similarly to existing super soaker squirt guns in which water is pressurized by the user (in this case, passenger or rider) operating a manual pump and/or piston mechanism and then pulling or activating a triggering mechanism (or, optionally, the water could be sprayed at low pressure as it is drawn through the cannon 826, 846). In some embodiments, the cannons 826, 846 are fixed upon the bodies 822, 842 with no movement possible for targeting while in other embodiments the cannons 826, 846 are mounted for pivoting about two axes to allow lateral targeting and to allow trajectory or vertical angle targeting. In this manner, the ride 800 provides an interactive rotating water ride that allows passengers to spray water onto non-riding participants about the periphery of the ride and onto other vehicles 820, 840 such as those immediately following or, in some cases, leading vehicles.

Figure 9:
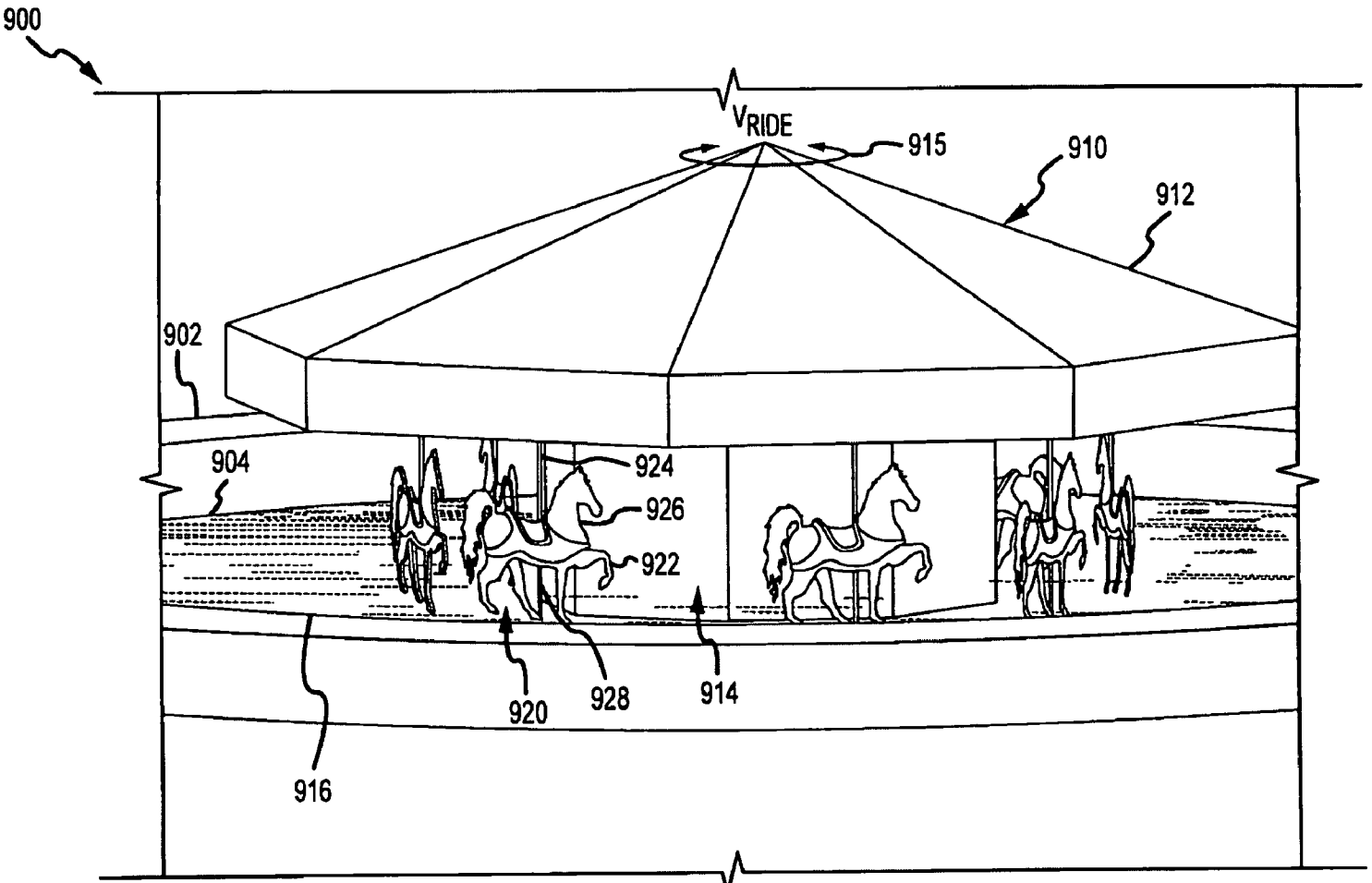
FIGS. 9 and 10 illustrate a perspective view and a detailed perspective view of a rotating ride based on a carousel configuration for rotating vehicle bodies about a hub with, in this case, water fill from a reservoir in which the carousel is positioned.
Figure 10:
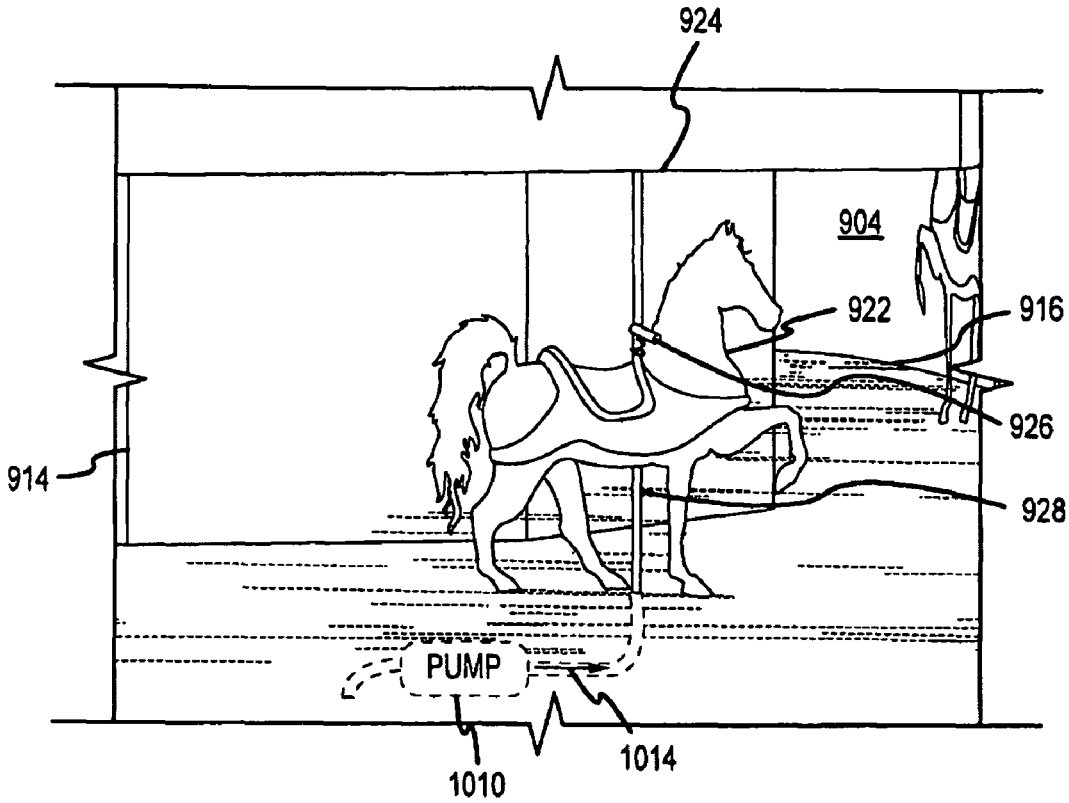

FIGS. 9 and 10 illustrate another ride assembly 900 that provides a rotating ride experience with interactive water features. As shown, the ride assembly 900 provides a carousel drive assembly 910 that rotates a hub or center section 914 along with an attached roof 912 and platform 916 at a ride velocity, $V_{ride}$, in a clockwise and/or counterclockwise direction. The rotating ride 900 includes a plurality of carousel ride elements 920 that include a body 922 with seating for one or more passengers. The body 922 is attached or supported on the platform 916 via a pole or other mounting structure 924, which may move up and down as the hub 914 rotates 915.

The ride 900 provides the three interactive water subsystems of storage, fill, and release. Specifically, water storage may be provided fully or in part in an off-board manner such as with a reservoir (not shown) above or below the body 922 or may be provided by the supply or fill tank 902 and the water 904 in which the carousel 910 rotates. In other cases, a portion of the storage is provided within a water cannon 926 and/or within the body 922 and connected to the cannon 926. Water fill is provided via the reservoir 902 and as shown in FIG. 10 a pump 1010 that may be in or connected to the water 904 in basin 902 (e.g., positioned underneath the platform 916 to be hidden from view). A fill line (piping and/or tubing) or manifold 1014 connects to a second or local fill line 928 provided for each body 922. The local fill line 928 is connected, in turn, to the inlet or storage reservoir of the water cannon 926. As with the ride 800, the filling process (e.g., operation of pump 1010) may be automated to attempt to provide an ongoing supply of water to the cannons or soaking devices 926 or based on ride programming or sensing of fill of a reservoir. In other cases, the passenger may take some action to initiate fill of their device 926.

The water release functionality may be provided in a number of manners to use the ride 900. As shown, the cannon 926 may be pivotally mounted on the body 922 to allow lateral or side-to-side rotation or targeting and/or to allow vertical or up-and-own rotation or targeting. In other cases, the fill line 928 is flexible or a portion is to allow the cannon or device to be targeted manually by hand (e.g., the device 926 may be handheld such as soaking device that can be holstered and then withdrawn to spray water on another passenger or some non-rider that is near the periphery of the carousel 910). The release may be manual with a pump and trigger as discussed with ride 800 or the water in the line 928 may be adequately pressurized (by an on or off board pump or the like) such that the releasing subsystem or mechanism may simply be a triggering device (e.g., such as on watering or spraying device placed on the end of a fire hose or a hose connected to a residential water spigot).

Figure 11:
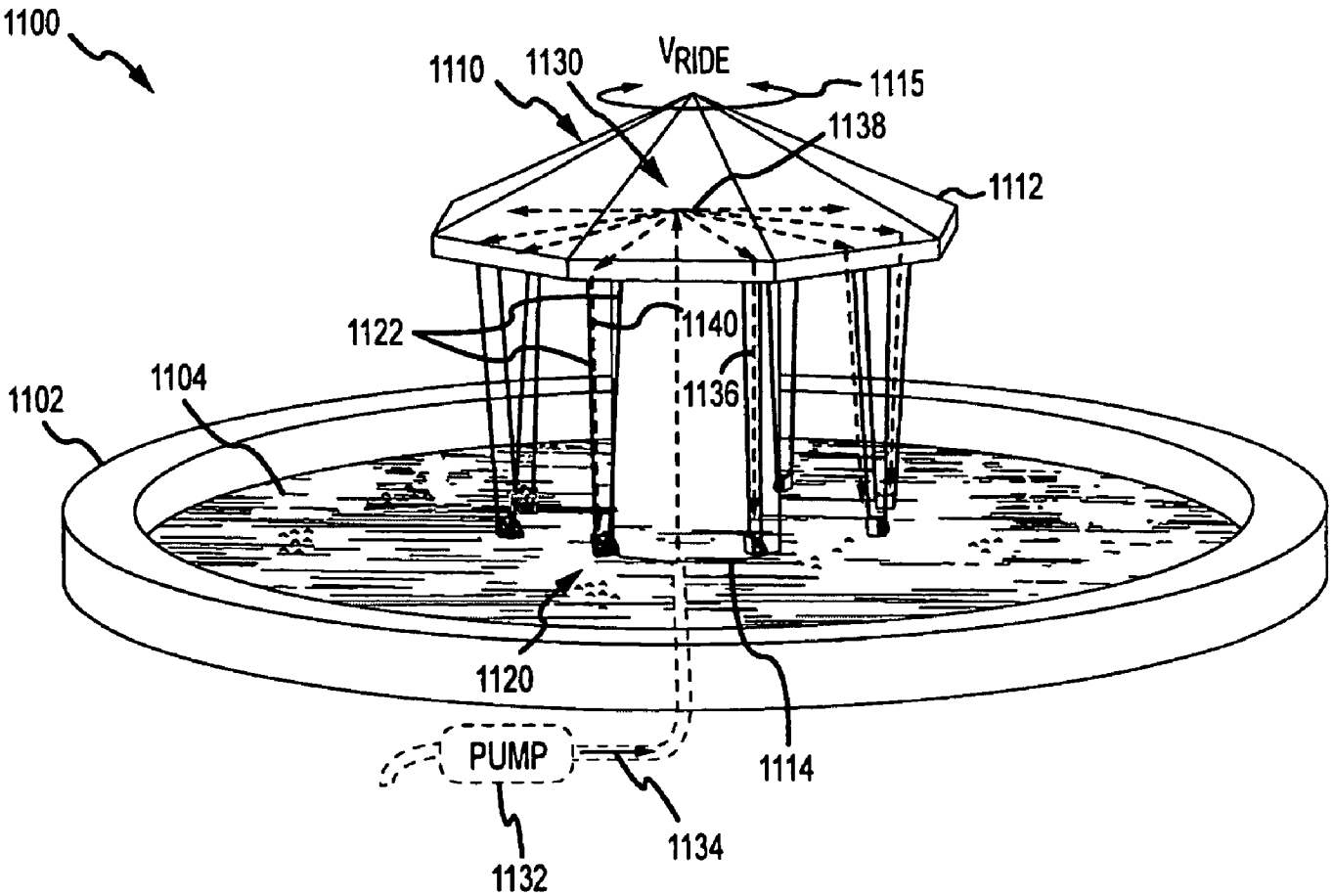
FIGS. 11 and 12 illustrate a perspective view and a detailed perspective view of another rotating ride of the invention providing interactive water features in a rotating swing platform and providing automated fill to an onboard reservoir/container.
Figure 12:
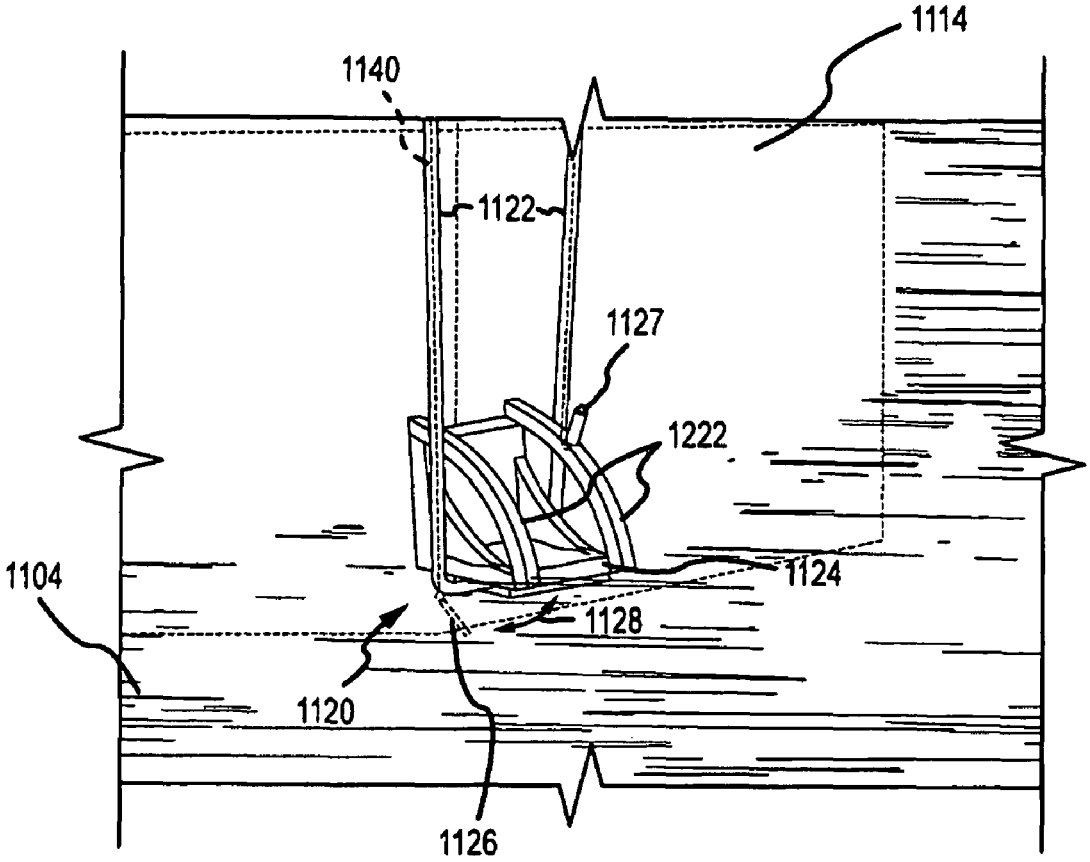

FIGS. 11 and 12 show yet another rotating ride 1100 that may be used to provide interactive water features to guests or passengers. Spinning or rotating swing rides are well known and the ride 1100 may utilize a central rotating drive assembly 1110 similar to such swinging chair rides. The drive assembly 1110 may include a central hub 1114 that rotates 1115 at a ride velocity, $V_{ride}$, along with a support structure for a plurality of chair connectors 1122 (e.g., flexible cables, chains, or the like) with the roof 1112 being stationary (while in other cases the roof 1112 provides the support structure and rotates itself). The ride 1100 further includes a plurality of passenger chair or vehicle assemblies 1120 that are suspended from the rotating support structure by chair connectors 1122.

Again, the three water interaction subsystems of water storage, water fill, and water release are provided in the ride 1100. Water storage may be provided on board in the chair assembly 1120 such as in a container or reservoir formed integrally or otherwise part of a swing seat (e.g., vehicle body) 1124. Typically, the storage volume would be relatively small such as less than about a gallon but some embodiments may provide seats with extended bottom portions providing a larger water storage container or reservoir in the seat 1124. Water fill may be provided from a pressurized source and may be automated (e.g., based on sensing of the fill of the container in seat 1124 or based on other controls as discussed above for other ride embodiments). The source may be any off board source that may be plumbed to an inlet or fill line 1136 in or on the hub structure 1114, and, in one example, the ride 1100 includes a basin or pool 1102 in which supply or fill water 1104 is stored for use in the ride. In this example, a pump 1132 with an inlet 1134 is placed in or the inlet is placed in connection with basin 1102, and the pump 1132 pumps water through main fill line 1136 of the fill assembly 1130. The fill assembly 1130 also includes distribution header or manifold 1138 that distributes water via pressurize water lines 1140 to the onboard container in chair 1124. The line 1140 may, for example, be flexible hose or tubing run along one or both of the chair connectors 1122.

The release or discharge of the water from the container in chair 1124 may be manual as described for the Ferris wheel-type chairs or, in other cases, the release may be powered. For example, a passenger in the chair assembly 1120 may be able to depress a switch or button to activate an on-board pump or move a lever 1127 on the chair structure 1222 to release or activate a solenoid-controlled latch or the like that is used to maintain a trap door or pivotal opening member 1126. The weight of any stored water and the weight of the door 1126 may be used to cause the door 1126 to swing open and release the water, which due to the relatively high rotation rates, $V_{ride}$, will spray quickly outward from the rotating ride 1100 onto people in a pedestrian area near the ride 1100. A resilient member such as a spring or the like may be used to return the door 1126 to the closed position after water is released from the chair 1124 at which point the solenoid or other user-releasable latch member will retain the door 1126 in the closed position and allow additional fill water to be provided by supply/fill system 1130 to onboard storage/container in chair 1124.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A ride for in use amusement parks and other settings to provide passengers or park guests with an interactive water experience, comprising: a rotating ride with a drive assembly rotating a support structure about a central axis; and plurality of vehicles comprising a body with a seat for a passenger and connected to the support structure to rotate with the support structure and further comprising a water release mechanism operable by the passenger to release water from the plurality of vehicles during the rotating of the vehicles, wherein the body comprises a water storage reservoir for storing a volume of water prior to the release by the passenger, the volume of water being collected during rotation of the support structure about the central axis.

2. The ride of claim 1, wherein the stored water is collected from a water supply with an outlet spraying water into the body for capture through openings in the water storage reservoir.

3. The ride of claim 1, further comprising a body of water positioned relative to the structural assembly such that a collection inlet to the water storage reservoir passes through the body of water to collect the stored water.

4. The ride of claim 1, wherein the body comprises a release mechanism operable by the passenger to selectively create an outlet in the water storage reservoir to discharge a portion of the stored volume of water.

5. The ride of claim 4, wherein the body comprises a door defining at least a portion of a wall of the water storage reservoir and the release mechanism is connected to the door to open the door upon operation by the passenger.

6. The ride of claim 1, wherein the water release mechanism comprises a device for withdrawing the volume of water from the water storage reservoir, for pressurizing the withdrawn water, and a triggering mechanism for selectively discharging the pressurized water, wherein at least an outlet of the device of the water release mechanism is positionable to direct the discharged water toward a user selectable target.

7. The ride of claim 1, wherein the structural assembly including the drive assembly and the support structure are configured based on a Ferris wheel ride, a round iron ride, a carousel, or a rotating swing ride.

8. A water ride system for use in providing an interactive water experience, comprising:

a rotating ride assembly comprising a plurality of vehicles rotated about a central axis by a drive; and a water supply providing fill water to the vehicles;

wherein the each of the vehicles comprises a body for receiving a passenger and a water collection and storage assembly comprising a reservoir for storing a volume of the fill water until released in response to input from the passenger and an opening for receiving the fill water and directing the received fill water to the storage reservoir and wherein the receiving of the fill water occurs during operation of the drive to rotate the vehicles about the central axis.

9. The ride system of claim 8, wherein the water supply comprises a pool of the fill water positioned proximate to the rotating ride assembly such that each of the vehicles are at least partially submerged in the pool to cause the fill water to flow in the opening to the storage reservoir.

10. The ride system of claim 8, wherein the water supply comprises one or more discharge pipes with outlets positioned over at least portions of the rotating ride assembly such that the fill water falls into the vehicles during operation of the rotating ride assembly.

11. The ride system of claim 8, wherein each of the vehicles further comprises a water release assembly operable by the passenger to selectively release a portion of the fill water from the storage reservoir.

12. A ride assembly, comprising: a rotating ride assembly comprising a plurality of vehicles; a drive operable to rotate a vehicle support; a water supply; and the plurality of vehicles are attached to the vehicle support to move generally in a circular pattern during operation of the drive, wherein each of the vehicles have a body with a seat for a passenger and further comprising: fill and storage means for obtaining, during rotation of the vehicle support by the drive, a volume of fill water from the water supply and storing the fill water on the body; and release means for releasing a portion of the volume of the obtained fill water in response to a triggering action by the passenger.

13. The assembly of claim 12, wherein the fill and storage means comprises a storage reservoir including an interior chamber in the body adapted to receive and contain the volume of fill water.

14. The assembly of claim 13, wherein the release means comprises a release mechanism responding to the triggering action to provide an opening in a lower portion of the storage reservoir to gravity drain the portion of the volume from the storage reservoir.

15. The assembly of claim 13, wherein the fill and storage means comprises an inlet to the storage reservoir, wherein the water supply comprises a pool of water, and wherein the water supply is positioned relative to the drive such that during rotation of the drive the inlet to the storage reservoir passes beneath a surface of the water in the pool to collect the volume of fill water.

16. The assembly of claim 12, wherein the water supply comprises a supply of pressurized water and fill and storage means comprises a fill line extending from the supply of pressurized water to the vehicle body.

17. The assembly of claim 12, wherein the release means comprises a manually operable pump for pressurizing the portion of the volume of the obtained fill water prior to the releasing from the vehicle.

18. The assembly of claim 17, wherein the release means further comprises an outlet portion that is positionable by the passenger to select a direction for discharge of the pressurized portion of the fill water.

19. The assembly of claim 12, the vehicle support comprises a wheel frame adapted to pivotally support the vehicles and the drive and vehicle support are configured to rotate the wheel frame in a substantially vertical plane.

* * * * *